US006213826B1

(12) United States Patent
Koishikawa et al.

(10) Patent No.: US 6,213,826 B1
(45) Date of Patent: Apr. 10, 2001

(54) OUTBOARD MOTOR, AND ENGINE THEREOF

(75) Inventors: Kouji Koishikawa; Masaki Tsunoda; Hitoshi Suzuki; Yoshimi Watanabe; Shigeaki Kuwabara, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/568,015

(22) Filed: May 10, 2000

Related U.S. Application Data

(62) Division of application No. 09/361,611, filed on Jul. 27, 1999, now Pat. No. 6,079,384, which is a division of application No. 08/932,171, filed on Sep. 17, 1997, now Pat. No. 5,964,197, which is a continuation of application No. 08/344,648, filed on Nov. 18, 1994, now abandoned.

(30) Foreign Application Priority Data

Nov. 19, 1993 (JP) ..... 5-312857
Aug. 26, 1994 (JP) ..... 6-223923

(51) Int. Cl.[7] ..... B63H 21/10

(52) U.S. Cl. ..... 440/88; 440/89; 123/196 W; 123/195 P

(58) Field of Search ..... 123/195 P, 196 W; 440/88, 89, 900

(56) References Cited

U.S. PATENT DOCUMENTS

| | | | | |
|---|---|---|---|---|
| 2,357,942 | * | 9/1944 | Farr | 123/195 P |
| 2,976,836 | | 3/1961 | Fageol | 123/195 |
| 4,772,236 | | 9/1988 | Takahashi | 440/89 |
| 4,881,510 | | 11/1989 | Etoh et al. | 123/572 |
| 4,907,551 | | 3/1990 | Sakono et al. | 123/196 R |
| 4,930,467 | | 6/1990 | Masuda et al. | 123/179.28 |
| 4,945,887 | | 8/1990 | Sakurai et al. | 123/573 |
| 5,036,805 | | 8/1991 | Yamamoto et al. | 123/59 PC |
| 5,049,100 | | 9/1991 | Yamamoto et al. | 440/77 |
| 5,163,394 | | 11/1992 | Koishikawa et al. | 123/196 W |
| 5,174,112 | | 12/1992 | Sougawa et al. | 60/302 |
| 5,231,958 | | 8/1993 | Takahashi et al. | 123/73 A |
| 5,388,555 | | 2/1995 | Shiomi et al. | 123/195 P |
| 5,438,963 | | 8/1995 | Tsunoda et al. | 123/54.4 |

(List continued on next page.)

FOREIGN PATENT DOCUMENTS

| | | |
|---|---|---|
| 2 313 232 | 3/1973 | (DE) . |
| 27 37 861 | 3/1979 | (DE) . |
| 0 380 883 | 12/1989 | (EP) . |
| 529 771 | 12/1921 | (FR) . |
| 2 554 166 | 12/1984 | (FR) . |
| 328 490 | 5/1930 | (GB) . |
| 2 142 087 | 1/1985 | (GB) . |
| 60-43171 | 3/1985 | (JP) . |

*Primary Examiner*—Ed Swinehart
(74) *Attorney, Agent, or Firm*—Armstrong, Westerman, Hattori, McLeland & Naughton

(57) ABSTRACT

An outboard motor body case supported on a swivel shaft through a connecting member. The swivel shaft is vertically swingable about a tilting shaft. An engine is mounted at an upper portion of the outboard motor body case, with a crankshaft thereof being oriented vertically, and a flywheel is mounted at a lower end of the crankshaft and disposed between an engine block and the connecting member. A dynamo is mounted within the flywheel, and a starter motor is engaged with a ring gear which is formed around an outer periphery of the flywheel. Thus, since the flywheel having a large weight is mounted at the lower end of the crankshaft, the position of the center of gravity of the outboard motor is lowered. Therefore, it is possible to easily perform a tilting-up about the tilting shaft with a small force. Moreover, since the flywheel is mounted on a power taking-off side of the crankshaft, the torsional vibration of the crankshaft can be reduced.

1 Claim, 17 Drawing Sheets

U.S. PATENT DOCUMENTS

| | | | |
|---|---|---|---|
| 5,524,581 | 6/1996 | Rush II et al. | 123/90.34 |
| 5,553,586 | 9/1996 | Koishikawa et al. | 123/195 P |
| 5,596,962 | 1/1997 | Tsunoda et al. | 123/195 HC |
| 5,630,390 | 5/1997 | Tsunoda et al. | 123/195 P |
| 5,687,688 | 11/1997 | Tsunoda et al. | 123/196 W |
| 5,718,197 | 2/1998 | Tsunoda et al. | 123/196 W |
| 5,769,036 | 6/1998 | Takahashi et al. | 123/195 P |
| 5,778,847 | 7/1998 | Takahashi et al. | 123/195 P |
| 5,803,036 | 9/1998 | Takahashi et al. | 123/195 P |

* cited by examiner

OUTBOARD MOTOR, AND ENGINE THEREOF

This application is a div. of Ser. No. 09-361,611 filed Jul. 27, 1999 now U.S. Pat. No. 6,079,384 which is a div of Ser. No. 08/932,171 filed Sep. 17, 1997 now U.S. Pat. No. 5,964,197 which is a con of Ser. No. 08-344,648 filed Nov. 18, 1994 now aband.

BACKGROUND OF THE INVENTION

1. Field of the Invention

The present invention relates to an outboard motor detachably mounted at a stern for use to propel a boat or ship, as well as an engine mounted in the outboard motor. The engine according to the present invention can be utilized not only as an engine for the outboard motor, but also as a general-purpose engine.

2. Description of the Related Art

In a common type of the outboard motor of the related art, an engine (a vertical engine) having a flywheel provided at an upper end of a vertically directed crankshaft protruding from an engine block is mounted in an outboard motor body case which is mounted to a boat body through an antivibration mount. Such types of the outboard motors are disclosed, for example, In Japanese Patent Application Laid-open Nos.191610/87, 192917/88 and 192918/88.

In these outboard motors, a ring gear is mounted around an outer periphery of the flywheel, and a starter motor is mounted above a side of the engine and meshed with the ring gear. A driving pulley of a valve-operating belt drive transmission is provided at an end of the crankshaft adjacent below the flywheel.

Typically, an ignition power source coil and a charging power source coil are accommodated in the flywheel to form a dynamo and hence, the flywheel has a downwardly-turned bowl-like shape.

In such a prior art outboard motor, the heavy flywheel having a large inertial moment, which largely influences the determination of the gravity of the position of the center of engine, is spaced farther upwardly from the antivibration mount. The crankshaft end opposite from the flywheel is coupled to a driving shaft for transmitting a driving force to a propeller. Therefore, torsional vibrational effects exert a great influence on the selection of the antivibration mount and hence, the selection of the antivibration mount must be taken into special consideration.

In addition, not only the flywheel but also a starter must be mounted above the engine. Therefore, the position of the center of gravity of the engine is high, which increases the moment required during tilting-up of the outboard motor, and also limits the freedom of the disposition of other auxiliaries, especially, in the case of a multi-cylinder engine the disposition of an electrical equipment box for accommodating a CDI unit plurality of coils, other auxiliaries such as and intake system auxiliaries or the like.

Further, in a 4-cycle engine used in the outboard motor, the driving Pulley of the wrapping type transmission is provided as a valve operating device at the crankshaft end adjacent the flywheel. The crankshaft end however requires a large diameter for mounting the flywheel. Therefore, the diameter of the driving pulley must be increased and as a result, a driven pulley adjacent a camshaft also increased in size and has a shape occupying an area near an upper portion of a cylinder head, bringing about an increase in size of an upper portion of a rear end of an engine cover spaced from a tilting shaft. However, this portion of the engine cover is liable to interfere with a boat body structure, when the outboard motor is turned upwardly about the tilting shaft and hence, the unnecessary increase in size of this portion is undesirable and inconvenient even in respect of a moment required for the turning of the outboard motor.

A lower portion of the outboard motor body case is formed to be narrow in order to reduce the underwater resistance of a submerged portion of the case to the utmost and to provide a reduction in weight. Therefore, an engine having a good mountability to such outboard motor body case is desired.

In Japanese Utility Model Application Laid-open Nos.21509/91 and 23609/91, there has been proposed an engine in which a crankshaft is oriented vertically and a flywheel is provided at a lower end of the crankshaft protruding from an engine block. Such an engine includes a transmission connected to that lower end of the crankshaft which is provided with the flywheel. Thus, this engine cannot be applied directly as an engine for use in the outboard motor, and such prior art devices not suggest any means capable of solving problems inherent in the engine of the above-described type for use in the outboard motor.

SUMMARY OF THE INVENTION

Accordingly, it is a first object of the present invention to provide an outboard motor a low center of gravity, which is easy to tilt up and is less susceptible to torsional vibration.

It is a second object of the present invention to provide an engine which is excellent in mountability to the outboard motor body case.

To achieve the first object, according to the present invention, there is provided an outboard motor comprising an engine mounted at an upper portion of an outboard motor body case which is swingable about a tilting shaft, with a crankshaft of the engine being directed in a vertical direction, wherein the crankshaft is provided, with a flywheel, at a lower end thereof which protrudes downwardly from an engine body of the engine.

With the above construction, since the flywheel is provided at the lower end of the crankshaft, i.e., at a lower portion of the engine, the position of the center of gravity of the engine is lowered, so that a moment required for swinging the outboard motor upwardly (i.e., tilted up) about the tilting shaft is reduced. Therefore, the effort required of a person when the outboard motor is manually tilted up is reduced. Even when the outboard motor is tilted up by a tilting device such as a hydraulic device or the like, a prompt tilting-up operation can be achieved by a relatively small-sized tilting device. In addition, the flywheel is provided at the lower portion of the engine and moreover, can be accommodated by utilizing a space between a connecting member for supporting the outboard motor body case and the engine body. Therefore, the entire height of the outboard motor is relatively low. Further, the flywheel does not exist above a driving pulley of a valve operating device provided at an upper portion of the engine and therefore, even if the driving pulley is of a sufficiently small diameter, there is no problem for handling the pulley. Consequently, a driven pulley can also be of a small diameter (in a 4-cycle engine, the diameter of a driven pulley is twice the diameter of a driving pulley) and thus, it is possible to reduce the size of the engine and outboard motor because the height can also be lowered. Yet further, a driving force is derived from a crankshaft end on the same side as the flywheel and therefore, it is possible to reduce the torsional vibration of the crankshaft.

To achieve the second object, according to the present invention, there is provided an engine with a crankshaft directed vertically, comprising a flywheel provided at that lower end of the crankshaft which protrudes from an engine block, and an engine mount case coupled to a lower surface of the engine block for mounting the engine, the engine mount case having a peripheral wall which extends below the flywheel to surround at least a portion of the periphery of the flywheel.

With the above construction, notwithstanding the flywheel being provided at the lower portion of the engine, the engine can be easily placed in position through the engine mount case. Particularly, the engine is suitable for use in the outboard motor and can be easily and satisfactorily mounted to the outboard motor body case through the engine mount case.

The above and other objects, features and advantages of the invention will become apparent from the following description of preferred embodiments taken in conjunction with the accompanying drawings.

BRIEF DESCRIPTION OF THE DRAWINGS

FIGS. 1 to 12 illustrate a first embodiment of the present invention, wherein FIG. 1 is a side view of the entire outboard motor;

FIG. 2 is a right side view of an engine;

FIG. 3 is a left side view of the engine;

FIG. 4 is a cross-sectional view of the engine;

FIG. 5 is a diagram illustrating a fuel supply system;

FIG. 6 is a view of an end of an engine block on the side of a cylinder head;

FIG. 7 is a vertical sectional view taken along various sections of the engine including an axis of a crankshaft;

FIG. 8 is an enlarged view of a portion shown in FIG. 7;

FIG. 9 is a top view of an engine mount case;

FIG. 10 is a bottom view of the engine mount case;

FIG. 11 is a sectional view taken along a line 11—11 in FIG. 7; and FIG. 12 is a view of an end of the cylinder head on the side of a cylinder head cover;

FIGS. 13 to 19 illustrate a second embodiment of the present invention, wherein FIG. 13 is a side view of the entire outboard motor;

FIG. 14 is a vertical sectional side view of an engine;

FIG. 15 is a side view of the inside of an engine room taken along a vertical section of a cover member for covering the engine;

FIG. 16 is a sectional view taken substantially along a line 16—16 in FIG. 15;

FIG. 17 is a schematic plan view illustrating the arrangement of the engine and auxiliaries within the engine room;

FIG. 18 is a centrally vertical sectional view of an upper portion of an engine cover; and FIG. 19 is a sideways vertical sectional view of the upper portion of the engine cover.

DESCRIPTION OF THE PREFERRED EMBODIMENTS

A first embodiment of the present invention will be first described with reference to FIGS. 1 to 12.

Figure 1:
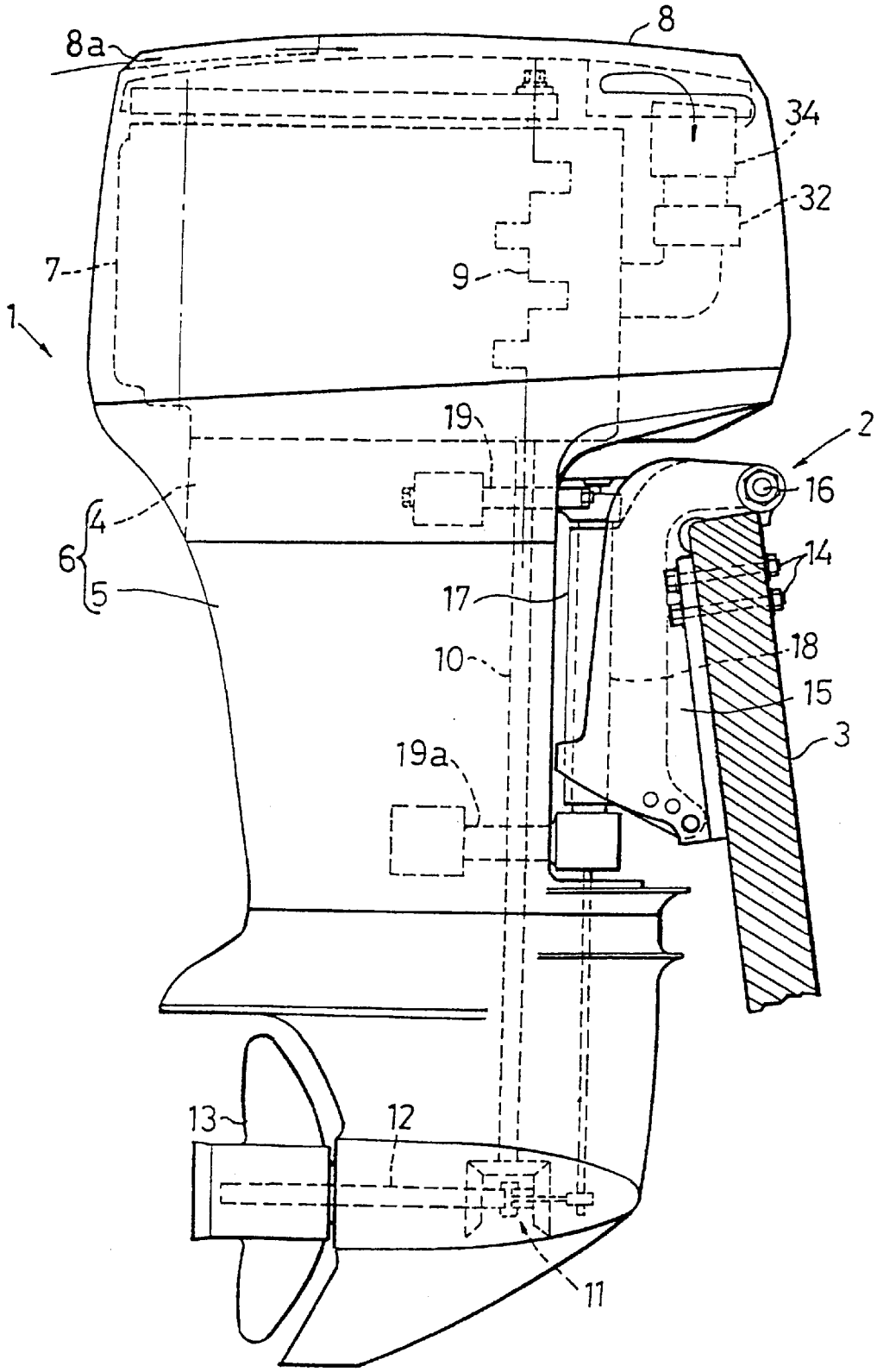

FIG. 1 is a side view of the entire outboard motor to which the present invention is applied. An outboard motor body 1 is mounted at a stern 3 through a mounting means 2.

The outboard motor body 1 includes an outboard motor body casing 6 which comprises an engine mount case 4 and an extension case 5. An engine 7 is mounted on an upper portion of the outboard motor body casing 6 and covered at its upper portion with an engine cover 8. The open air is introduced into the cover 8 through an air intake port 8*a*.

The engine 7 will be described hereinafter. A crankshaft 9 of the engine 7 is directed vertically, and a driving shaft 10 is connected to the crankshaft 9 and extends downwardly within the outboard motor body casing 6. The driving shaft 10 is connected at its lower end to a propeller shaft 12 through a forward and backward movement changing device 11. A propeller 13 is rotatively driven by an engine power transmitted thereto through the crankshaft 9, the driving shaft 10, the forward and backward movement changing device 11 and the Propeller shaft 12.

The mounting means 2 includes a bracket 15 fixed to the stern through a bolts 14, and a swivel case 17 pivotally mounted on the, bracket 15 for vertically swinging movement through a tilting shaft 16 provided at a front end of the bracket 15 to extend transversely. A swivel shaft 18 is rotatably carried in the swivel case 17 in a vertically directed manner. The outboard motor body casing 6 is connected to the swivel shaft 18 through upper and lower connecting members 19 and 19*a*. Thus, the outboard motor body casing 6, i.e ., the outboard motor body 1, is vertically swingable about the tilting shaft 16 and turnable in counterclockwise and clockwise directions about an axis of the swivel shaft 18.

Figure 2:
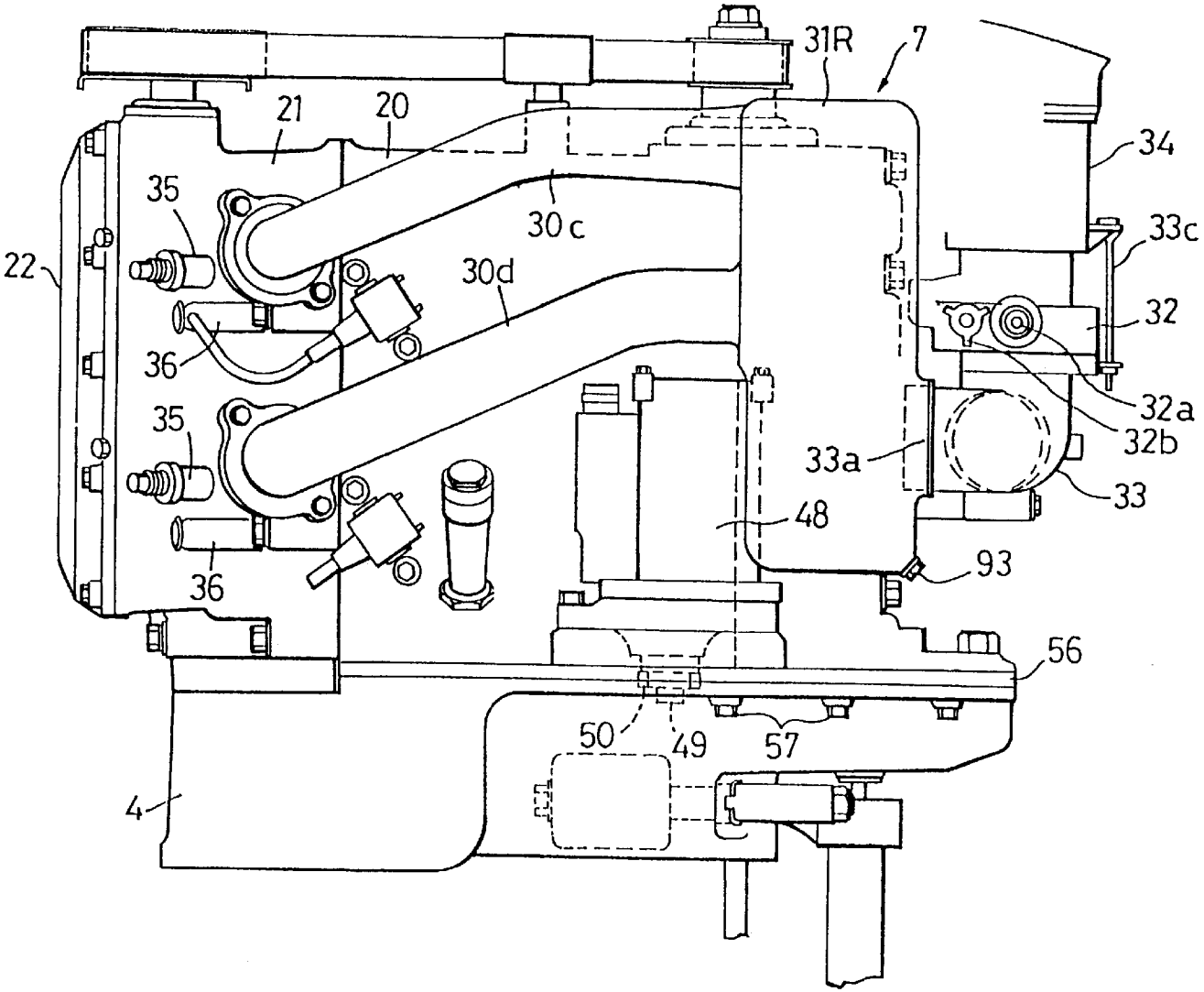
Figure 3:
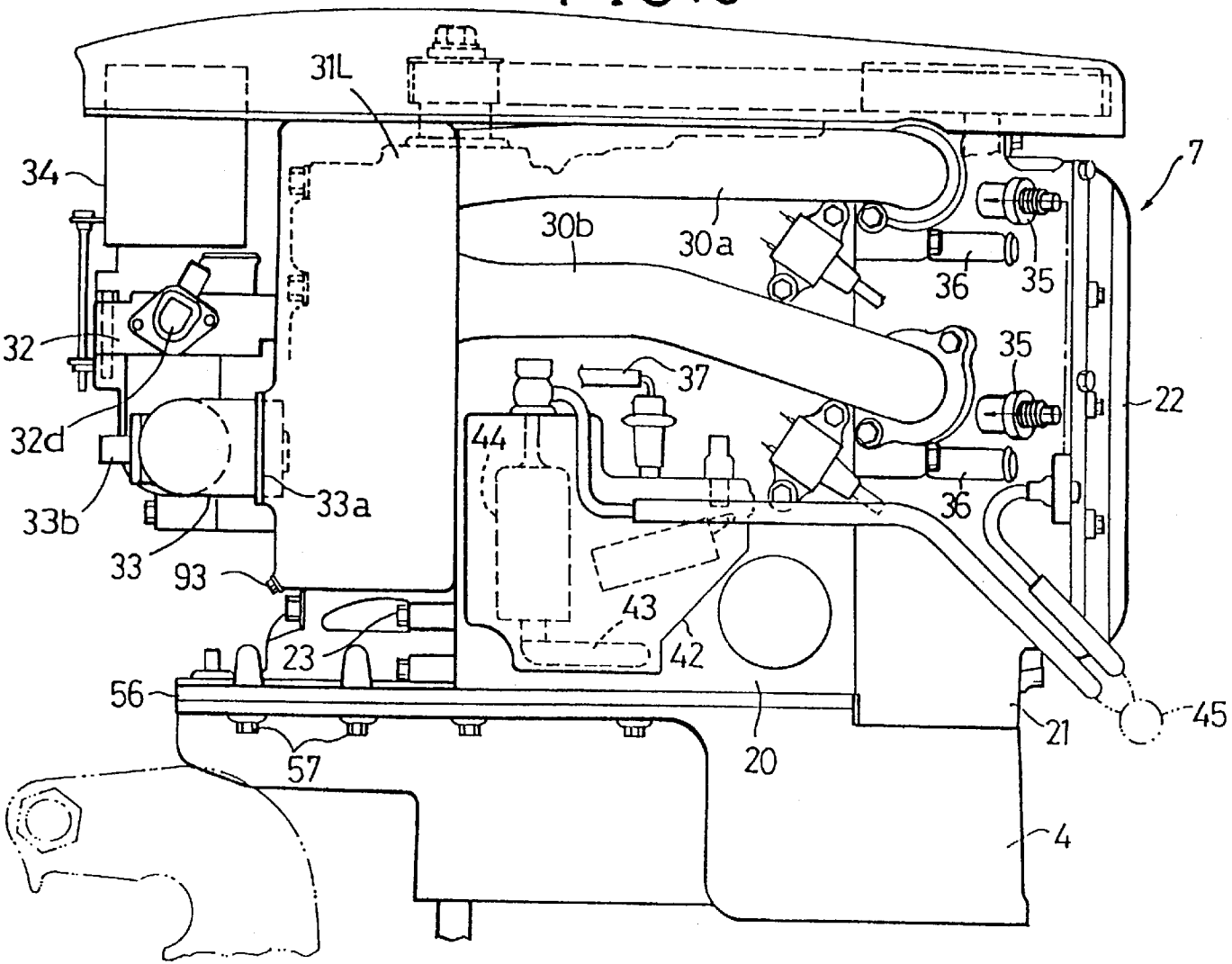
Figure 4:
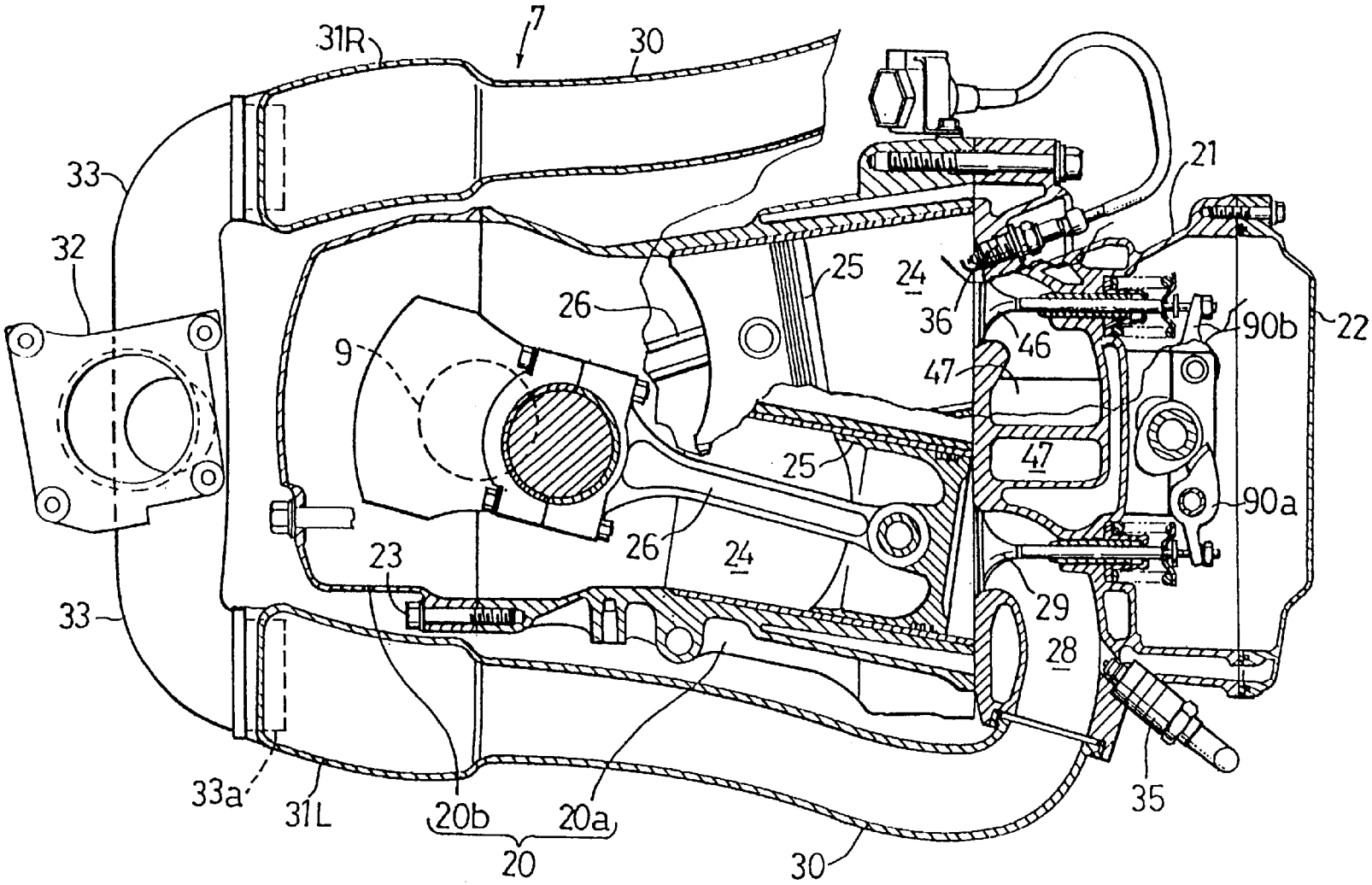

FIG. 2 is a right side view of the engine 7; FIG. 3 is a left side view, and FIG. 4 is a cross-sectional view. The terms "left" and "right" mean left and right when the outboard motor mounted at the stern 3 is viewed forwardly from rear (rightwardly from left in FIG. 1).

An engine body of the engine 7 includes an engine block 20, a cylinder head 21 and a cylinder head cover 22. The engine block 20 is constructed by integrally coupling a cylinder block portion 20*a* integrally provided with a skirt forming a half of a crankcase, with the remaining crankcase portion 20*b* by a bolt 23. Two sets of upper and lower pairs of cylinders 24, 24 arranged into a laterally V-shaped configuration are disposed within the engine block 20. More specifically, the engine 7 is a V-type 4-cycle engine with pistons 25 connected to the single crankshaft 9 directed vertically through connecting rods 26.

Figure 6:
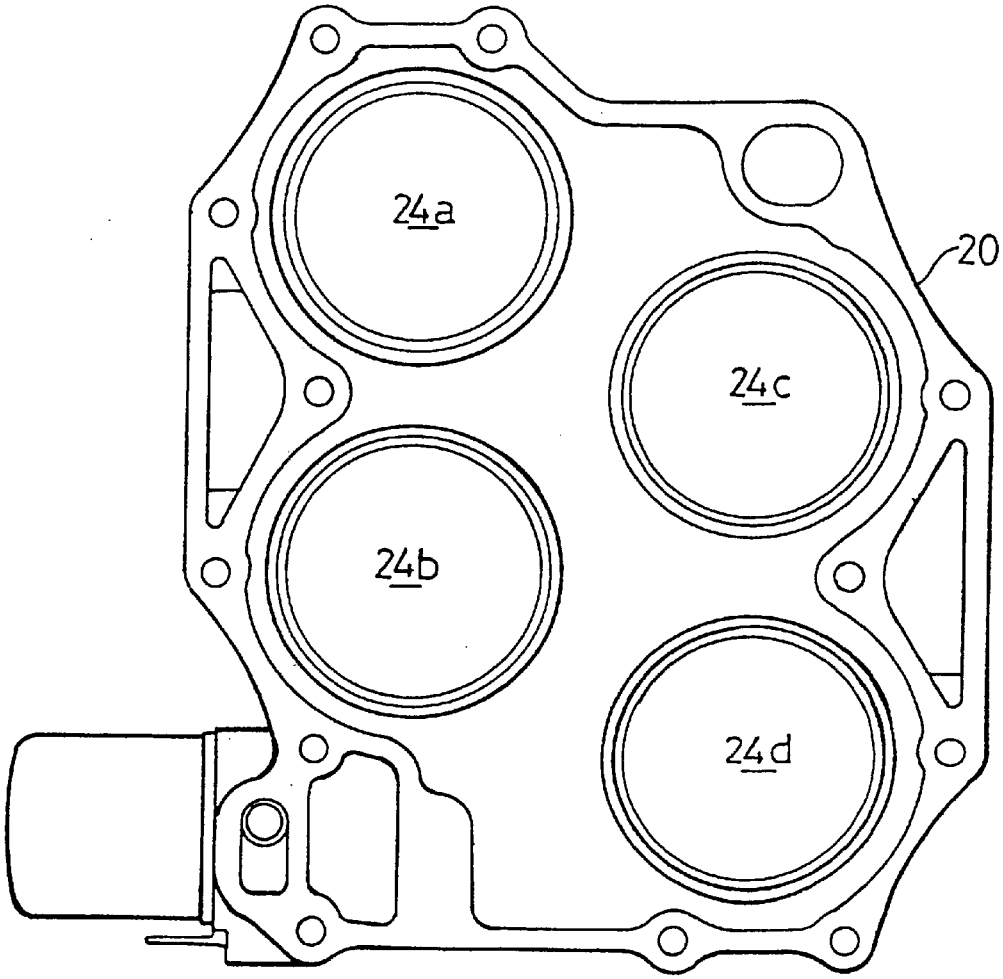

FIG. 6 is a side view of the engine block 20 on the side of the cylinder head 21. As can be seen from FIG. 6, the cylinders 24 are four cylinders: a pair of cylinders 24*a* and 24*b* vertically arranged on the left side, and another pair of cylinders 24*c* and 24*d* vertically arranged on the right side. These cylinders are arranged in a zigzag manner such that the left cylinders 24*a* and 24*b* are higher in level than the right cylinders 24*c* and 24*d*. Such arrangement of the cylinders makes it possible to reduce the lateral width of the engine block, as compared with another V-type engine and to reduce the size of the engine 7.

Intake ports 28 are provided in the cylinder head 21 in correspondence to the cylinders 24, as shown in FIG. 4 with regard to the left (left in the outboard motor, i.e., lower as viewed in FIG. 4) cylinder 24. The intake ports 28 are connected to the corresponding cylinders 24 through intake valves 29 and open into a side surface of the cylinder head 21. Intake pipes 30 are connected to such openings of the intake ports 28, respectively and extend along the side surface of the engine block 20 toward a crank chamber provided ahead. The intake pipes 30*c* and 30*d* shown in FIG.

2 are those corresponding to the cylinders 24*c* and 24*d* shown in FIG. 6 and the intake pipes 30*a* and 30*b* shown in FIG. 3 are those corresponding to the cylinders 24*a* and 24*b* shown in FIG. 6.

Surge tanks 31L and 31R are provided on the laterally opposite sides of a front portion of the engine block 20, and the intake pipes 30*a* and 30*b* are in communication with the surge tank 31L, while the intake pipes 30*c* and 30*d* are in communication with the surge tank 31R. On the other hand, a throttle body 32 having a throttle valve therein is disposed on a front and central portion of the engine block 20, and is in communication with the surge tanks 31L and 31R through an air passage 33 which diverges laterally from the throttle body 32. Air is introduced from above into the throttle body 32 via an air introducing pipe 34.

The air introduced from above via the air introducing pipe 34 is adjusted in flow rate within the throttle body 32 and then distributed into the left and right surge tanks 31. From the tanks 31, the air is supplied as combustion air through the intake pipes 30 into the corresponding cylinders 24, wherein fuel is injected from a fuel injection valve 35 and mixed with to such air in the intake ports 28 (FIG. 4). In FIG. 2, reference character 32*a* is a throttle valve stem; reference character 32*b* is a link member; and reference character 32*c* is a fastener of a rubber or the like. In FIG. 3, reference character 32*d* is a throttle valve opening degree sensor, and reference character 33*b* is an intake air temperature sensor.

The surge tank 31 has a connection 33*a* to the air passage 33 on a side thereof, and has a capacity area extending vertically i.e., upwardly and downwardly of the connection 33*a*. The volume of the capacity area is set as required, but a portion of the capacity area lying below the connection 33*a* is located out of a flow of air from the connection 33*a* to a connection with each intake pipe 30. Hence, should water enter an intake system, such portion also acts as a separating chamber. Reference character 93 is a drain bolt.

Figure 5:
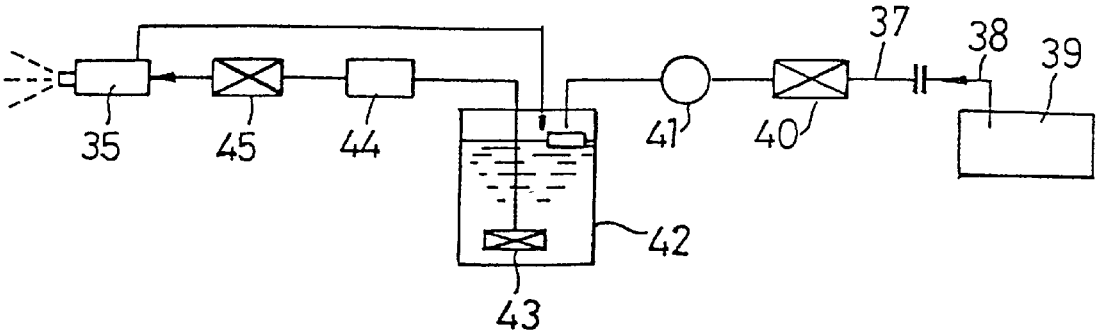

FIG. 5 is a diagram illustrating a fuel supply system. Reference character 37 is a fuel receiving pipe mounted in the outboard motor, and reference character 38 is a fuel delivering pipe mounted on a boat. By connecting these pipes 37 and 38, the fuel can be supplied from a fuel tank 39 mounted on the boat. Reference character 40 is a low-pressure filter, and reference character 41 is a low-pressure pump. The fuel pumped from the fuel tank 39 by the low-pressure pump 41 is once stored in a gas-liquid separator 42 and then supplied via a strainer 43, a high-pressure pump 44 and a high-pressure filter 45 to the fuel injection valve 35. These devices and pipes mounted on the outboard motor are disposed on the left side of the engine, as shown in FIG. 3. The high-pressure pump 44 may be disposed within the gas-liquid separator 42.

Figure 12:
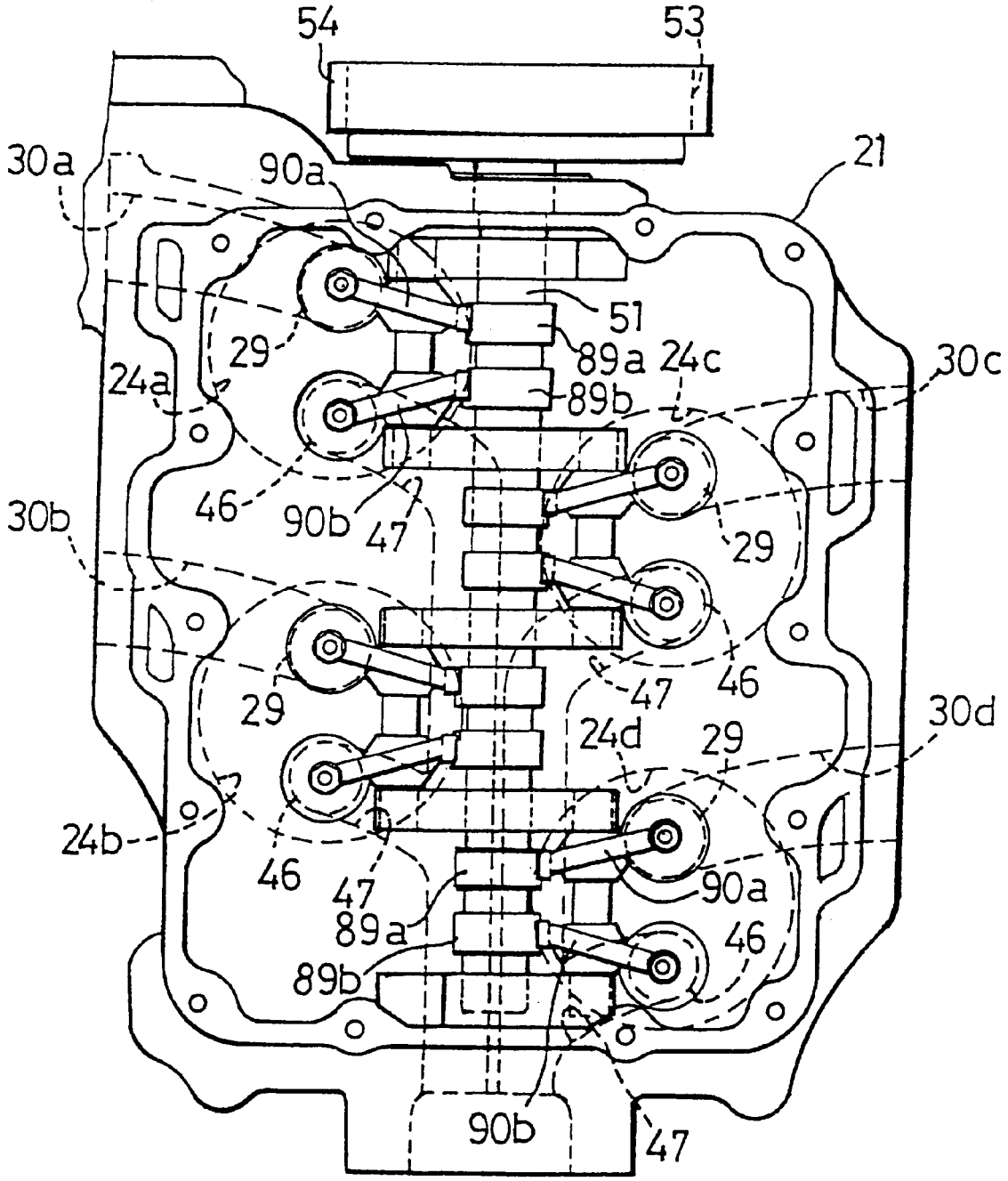

An exhaust valve 46 is mounted below the intake valve 29 in each of the cylinders 24 (see FIG. 4), and an exhaust passage 47 is defined in the cylinder head 21 to lead to each of the exhaust valves 46. The exhaust passages 47 extend vertically through a widthwise central portion of the cylinder head 21, i.e., through an intermediate section between the array of the left cylinders 24*a* and 24*b* and the array of the right cylinders 24*c* and 24*d* to meet together at lower ends and open into the lower surface of the cylinder head 21 (see FIGS. 7 and 12). A valve operating mechanism comprising a cam 89*a* and a rocker arm 90*a* for the intake valves 29, and a cam 89*b* and a rocker arm 90*b* for the exhaust valves 46 is shown in FIG. 12 only for the cylinders 2 *a* and 24*d*, but of course, a similar valve operating mechanism is mounted for each of the other cylinders.

As shown in FIG. 2, a starter motor 48 is mounted on the right side of the engine block 20 with its output shaft 49 protruding downwardly. A driving gear 50 is mounted to the output shaft 49 and meshed with a ring gear which is integrally formed around an outer periphery of a flywheel which will be described hereinafter.

Figure 7:
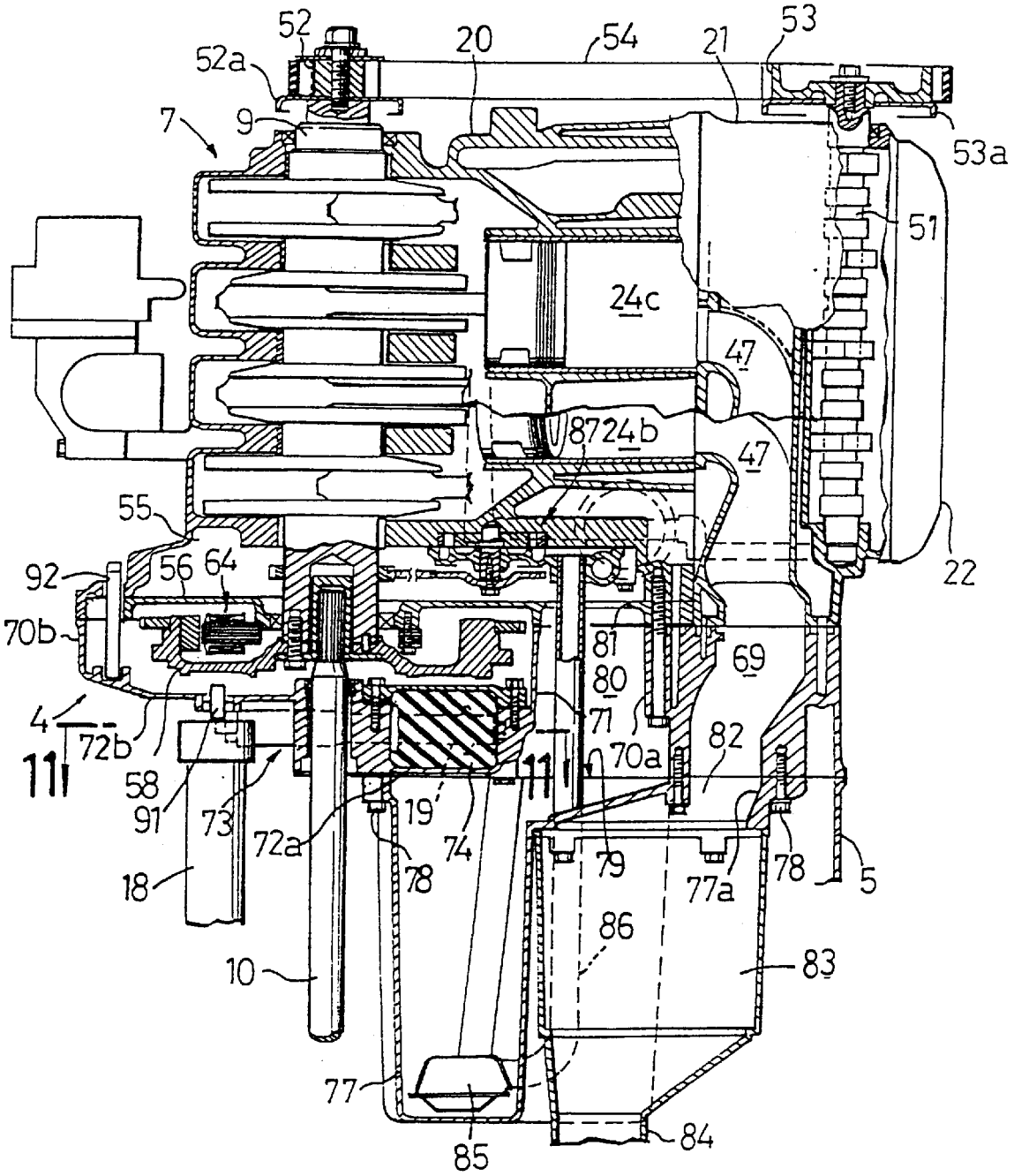

FIG. 7 is a view of the engine 7 taken in various vertical sections including an axis of the crankshaft 9, with a section of the cylinder 24*c* and a portion of a section of the cylinder 24*b* being shown.

The crankshaft 9 is directed vertically, as described above, and a camshaft 51 is disposed in the cylinder head 21 in parallel to the crankshaft 9. Upper ends of the crankshaft 9 and the camshaft 51 are passed through the engine block 20 and the cylinder head 21, respectively to project upwardly. Pulleys 52 and 53 are fixedly mounted at these upper ends. A belt 54 is wound around the pulleys 52 and 53. Thus, the camshaft 51 is driven by the crankshaft 9 through the belt 54. Since the engine 7 is a 4-cycle engine, the diameter of the pulley 53 is twice the diameter of the pulley 52 in order to set the rotational ratio of the crankshaft 9 to the camshaft 51 at 2:1. Reference characters 52*a* and 53*a* are controlling pick-up plates.

A lower surface of the engine block is formed into an open portion 55, and a lower wall of the engine block 20 is formed by a closing plate 56 for sealingly closing the open portion 55. The closing plate 56 is detachably secured to the engine block 20 by bolts 57 (FIGS. 2 and 3). A lower end of the crankshaft 9 is rotatably passed through to project downwardly, and a flywheel 58 is secured to such lower end.

Figure 8:
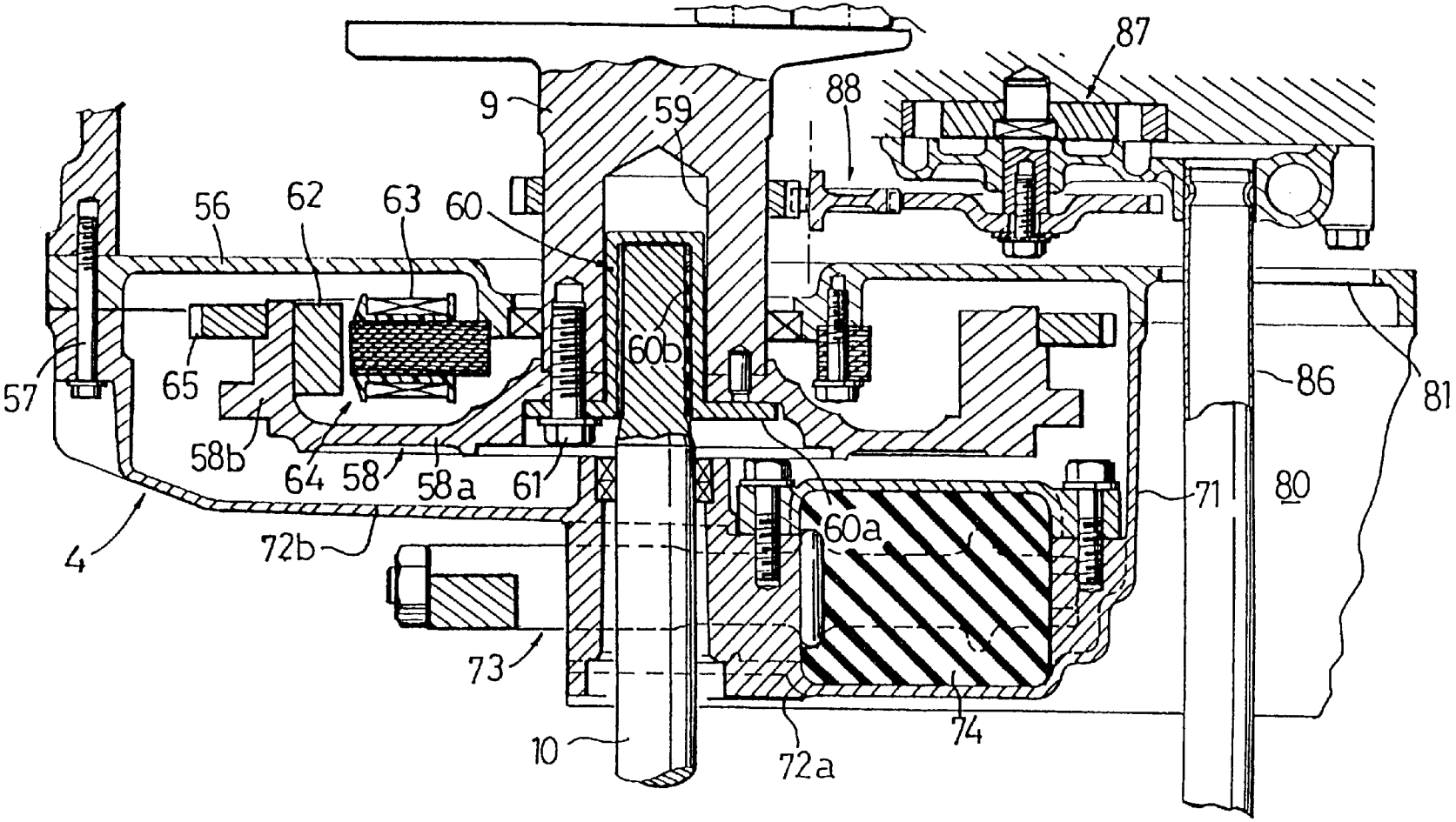

FIG. 8 is an enlarged view of a portion in the vicinity of the flywheel 58 shown in FIG. 7. An axial bore 59 is provided in the lower end of the crankshaft 9, and a collar member 60 is fitted in the bore 59. A circumferentially projecting annular flange 60*a* is formed at a lower end of the collar member 60. The flywheel 58 is secured to the crankshaft 9 by fitting a circular bore centrally provided in a bottom plate Portion 58*a* thereof over the collar member 60 and sandwiching their peripheral portions between a lower end face of the crankshaft 9 and the flange 60*a* to clamp them together by a bolt 61. The collar member 60 is also integrally fixedly secured to the crankshaft 9 by the bolt 61.

The flywheel 58 has a peripheral wall 58*b* projecting upwardly along an outer peripheral edge of the bottom plate portion 58*a* and is formed into a dish-like shape as a whole. A dynamo 64 is mounted within a space surrounded by the peripheral wall 58*b* and includes a rotor 62 fixed to the flywheel 58 and a starter 63 fixed to the closing plate 56.

Further, a ring gear 65 is integrally formed around an outer periphery of the peripheral wall 58*b* of the flywheel 58 by shrink-fitting of a gear portion or by another means. The ring gear 65 is meshed with the driving gear 50 provided on the output shaft 49 of the starter motor 48 (FIG. 2), and at the start of the engine, the crankshaft 9 is driven by the starter motor 48.

Figure 9:
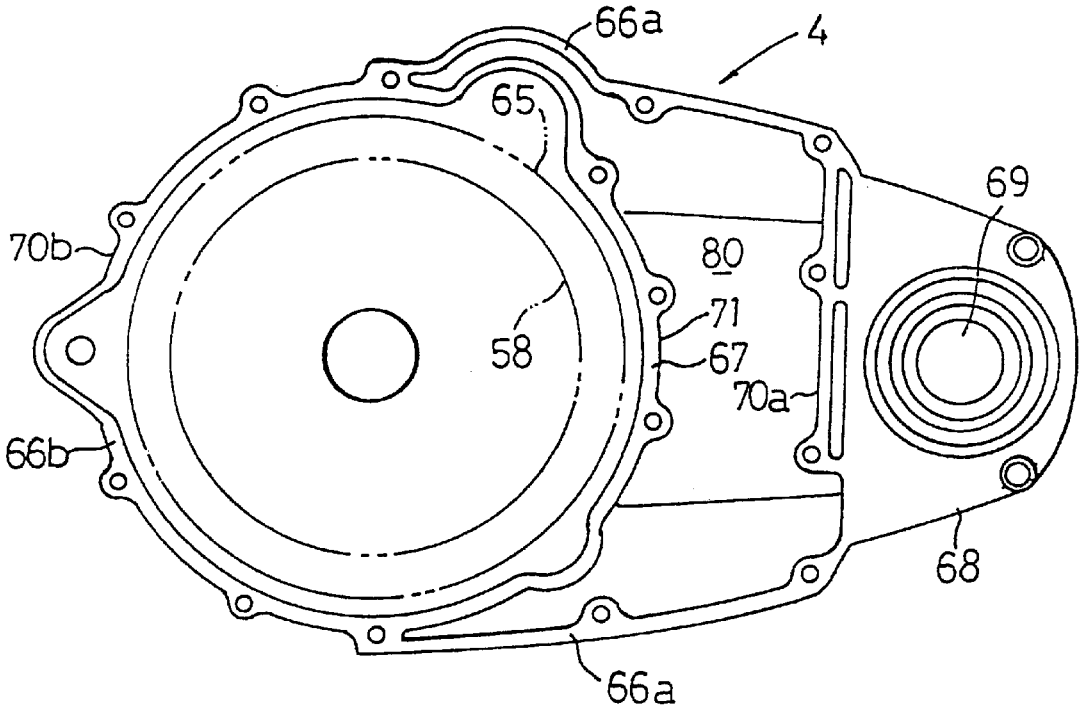

The engine mount case 4 is coupled to the lower surface of the engine block 20 along with the closing plate 56 interposed therebetween by clamping thereof using bolts 57. (In FIG. 7, reference character 91 is a shift rod, and reference character 92 is a shift rod operating member connected to the shift rod through a link system not shown, and FIG. 8 is another sectional view of these portions and the bolt 57 is shown.) The engine mount case 4 extends further rearwardly up to the vicinity of the cylinder head, and is also connected to the lower surface of the cylinder head 21 into which the exhaust passage 47 opens. FIG. 9 is a top view of the engine mount case 4, wherein reference characters 66*a* and 66*b* are packing surfaces extending along and abutting against the peripheral edge of the closing plate 56. A packing surface 67 is further provided to divide a space surrounded by the packing surfaces 66*a* and 66*b* into front and rear sections. The rear portion of the engine mount case 4 is in abutment against the lower surface of the cylinder head 21 through the packing surface 68 and is provided with an exhaust passage 69 communicating with the exhaust passage 47.

The engine mount case 4 has peripheral walls 70*a* and 70*b* extending downwardly from the packing surfaces 66*a* and 66*b*, respectively, and an enclosure wall 71 extending downwardly from the packing surface 67 (FIG. 7). All of the peripheral walls 70*a* and 70*b* and the enclosure wall 71 extend to positions lower than the flywheel 58. The periphery of the flywheel 58 is surrounded by the peripheral wall 70*b* and the enclosure wall 71. The lower end of the peripheral wall 70*a* is connected to a bottom plate 72*a*, and the lower end of the peripheral wall 70*b* is connected to a bottom plate 72*b*. These bottom plates 72*a* and 72*b* extend to positions below the central portion of the flywheel 58. However, the height (i.e., depth) of the peripheral wall 70*b* as measured from the packing surfaces 66*a*, 66*b* and 67 is lower than the height (i.e., depth) of the peripheral wall 70*a* and hence, the bottom plates 72*b* and 72*a* are superposed on each other in a vertically spaced apart relation below the central portion of the flywheel 58, and a mounting front opening 73 is defined therein to open forwardly.

The driving shaft 10 for transmitting the rotation of the crankshaft 9 to the propeller 13 is carried in the bottom plates 72*b* and 72*a* to vertically extend through the opening 73. An upper end of the driving shaft 10 is inserted from below into an internal bore 60*b* (FIG. 8) in the collar member 60 fitted to and spline-engaged with the crankshaft 9.

The connecting member 19 for connecting the swivel shaft 18 and the engine mount case 4 to each other is also inserted from front into the opening 73. The connecting member 19 includes two left and right connecting rods 19*a* and 19*b* to extend longitudinally on opposite sides of the driving shaft 10. Tip ends of the connecting rods 19*a* and 19*b* are connected to the engine mount case 4 through a mount rubber 74.

Figure 10:
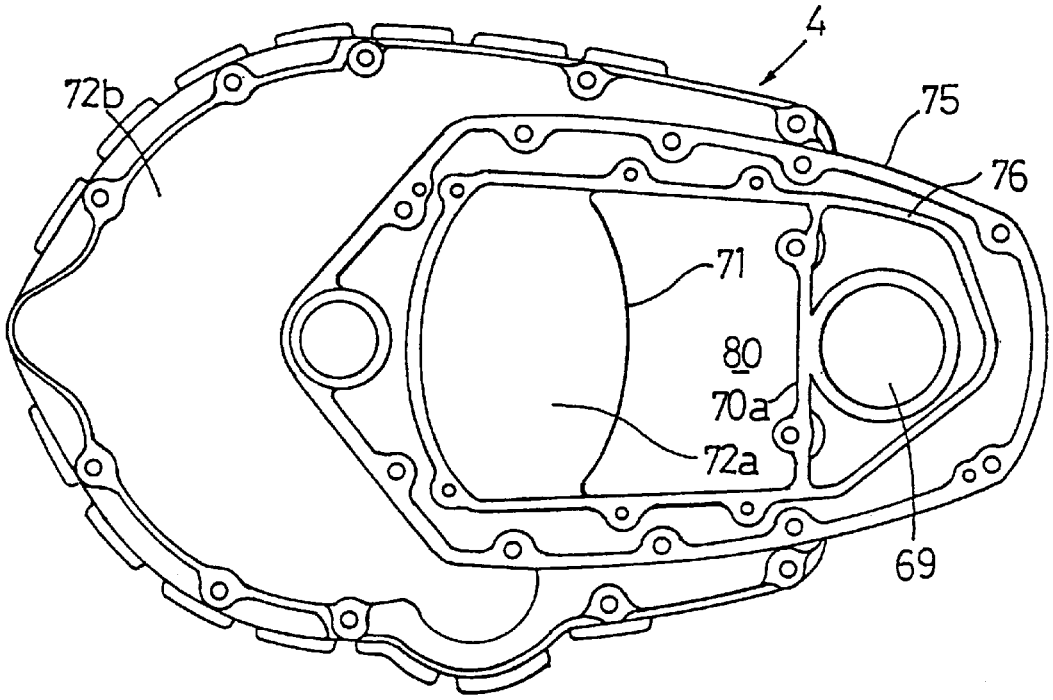
Figure 11:
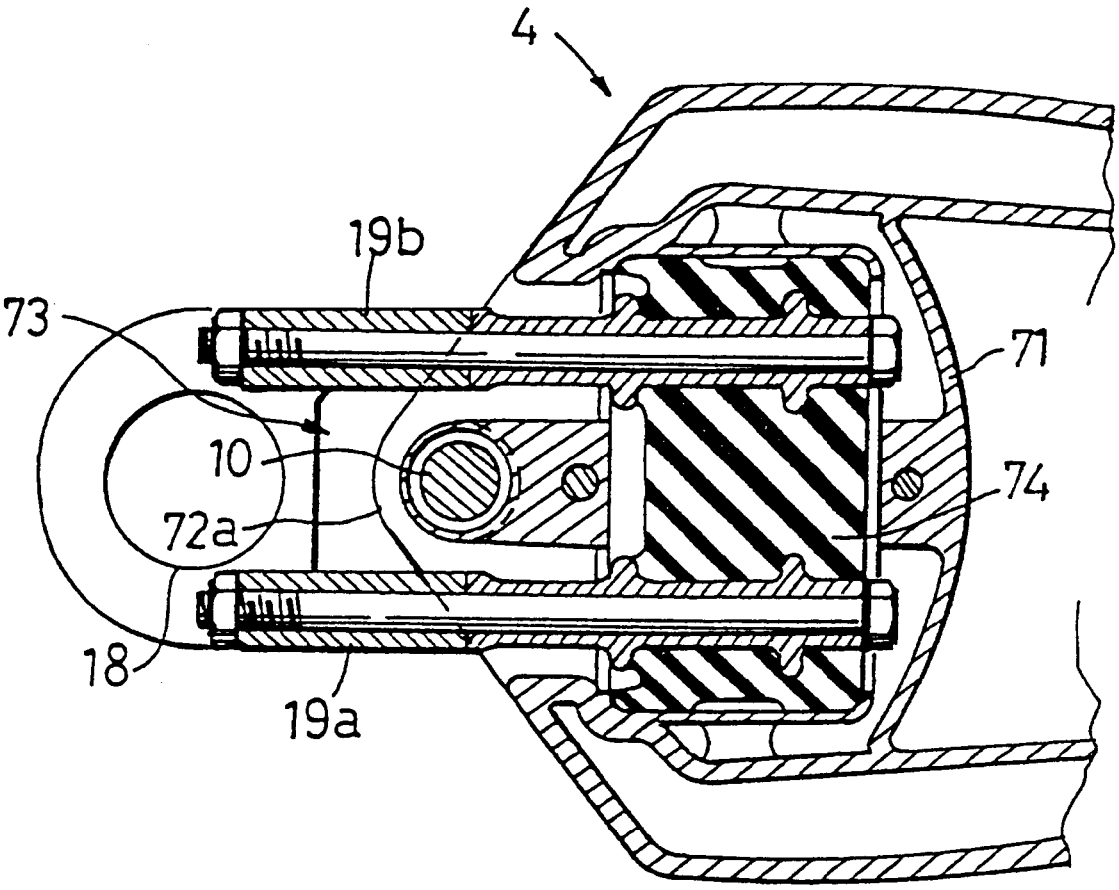

FIG. 10 is a plan view of the engine mount case as viewed from below. A mounting surface 75 is formed into an annular shape on the lower surface of the engine mount case 4 (lower surface of the bottom plate 72*a*). Thus, the engine 7 is mounted on the extension case 5 through the engine mount case 4 by clamping the engine mount case 4 to the peripheral edge of the upper end of the extension case 5 with the mounting surface 75 interposed therebetween.

An annular oil pan mounting surface 76 is also formed on the lower surface of the engine mount case 4 inside the mounting surface 75, and a peripheral edge of an upper end of an oil pan 77 is fastened to the oil pan mounting surface 76 by bolts 78, as shown in FIG. 7. An opening 79 in an upper surface of the oil pan 77 communicates with the inside of the engine block 20 through an oil communication passage 80 defined in the engine mount case 4 and an opening 81 provided in the closing plate 56. Oil which is returned from the crank chamber and accumulated on the closing plate 56 is passed through the opening 81 and the oil communication passage 80 and dropped from the opening 79 Into the oil pan 77. However, the opening 81 is provided on the side opposite from the flywheel 58 with respect to the enclosure plate 71 of the closing plate 56. Therefore, the oil on the closing plate 56 cannot enter a portion of the flywheel 58 which is surrounded by the peripheral wall 70*b* and the enclosure wall 71.

An exhaust pipe portion 77*a* is integrally formed at an upper portion of the oil pan 77 to protrude rearwardly. and an exhaust passage 82 is defined in the exhaust pipe portion 77*a* to communicate with the exhaust passage 69 in the engine mount case 4. The exhaust passage 82 communicates with a catalytic converter 83 juxtaposed outside the oil pan 77, and an exhaust gas purified in the catalytic converter 83 is passed through an exhaust pipe 84 and discharged from the lower portion of the extension case 5 into water.

The oil stored in the oil pan 77 is drawn through a strainer 85 and an intake pipe 86 into an oil pump 87 and supplied from the oil pump 87 to various portions of the engine. The oil pump 87 is driven by the crankshaft 9 through a gear train 88 (see FIG. 8).

In general, the center of gravity center of the outboard motor body is offset toward the center of the engine due to an influence of the heavy engine carried at the upper portion and is at a location higher than the tilting shaft. In the above-described embodiment, however, the flywheel 58 which was located at the uppermost portion of an engine in the prior art, is now provided at the lower end of the crankshaft 9, i.e., at the lower portion of the engine 7. Therefore, the gravity center of the engine 7 and thus the gravity center of the outboard motor body 1 is lowered to near the tilting shaft 16. Therefore, only a reduced moment is required to swing the outboard motor body 1 upwardly about the tilting shaft 16, thereby enabling an easy tilting-up or a prompt tilting-up.

The flywheel 58 provided at the lower portion of the engine 7 is accommodated in a space between the engine block 20 and the connecting member 19. Therefore, the entire height of the outboard motor body 1 is relatively low. Further, the flywheel does not exist above the pulley 52 and hence, even if the pulley 52 is made sufficiently small in diameter, there is no problem in handling the pulley. Thus, the pulley 53 may have a small diameter, leading to a reduction in size of the outboard motor body 1.

Notwithstanding that the flywheel 58 protrudes downwardly, the engine 7 can be easily placed at a predetermined location through the engine mount case 4 having the peripheral wall 70 extending below the flywheel 58 and particularly, can be easily and satisfactorily mounted on the outboard motor body 1.

In addition, since the flywheel 58 has the upper and lower portions covered by the closing plate 56 and the bottom plate 72, and its periphery is covered by the peripheral wall 70*b* and the enclosure wall 71 it is unlikely that, water will enter the area of the flywheel 58 from the outside and hence, the dynamo can be mounted without any influence exerted to positions around the dynamo 64.

Further, the engine 7 in the present embodiment can also be utilized as a horizontal power source with the crankshaft 9 arranged horizontally, by sealing the opening 81 in the closing plate 56, or by replacing the closing plate 56 itself and removing the oil pan 77.

In the starter motor 48 of the engine 7, the output shaft 49 thereof protrudes downwardly from the motor body to engage, from above, the ring gear 65 formed on the flywheel 58 located below the starter motor 48 and hence, the need to water proof such portion of the motor 48 can be avoided.

In the engine 7, the power take-off driving shaft 10 and the flywheel 58 are mounted at the same end of the crankshaft 9 and therefore, the vibration of the engine due to the crankshaft 9 is reduced.

A second embodiment of the present invention will now be described with reference to FIGS. 13 to 19. Reference numerals used in the first embodiment are basically different from those used in the second embodiment, and the same reference numeral may not necessarily designate the same element.

Figure 13:
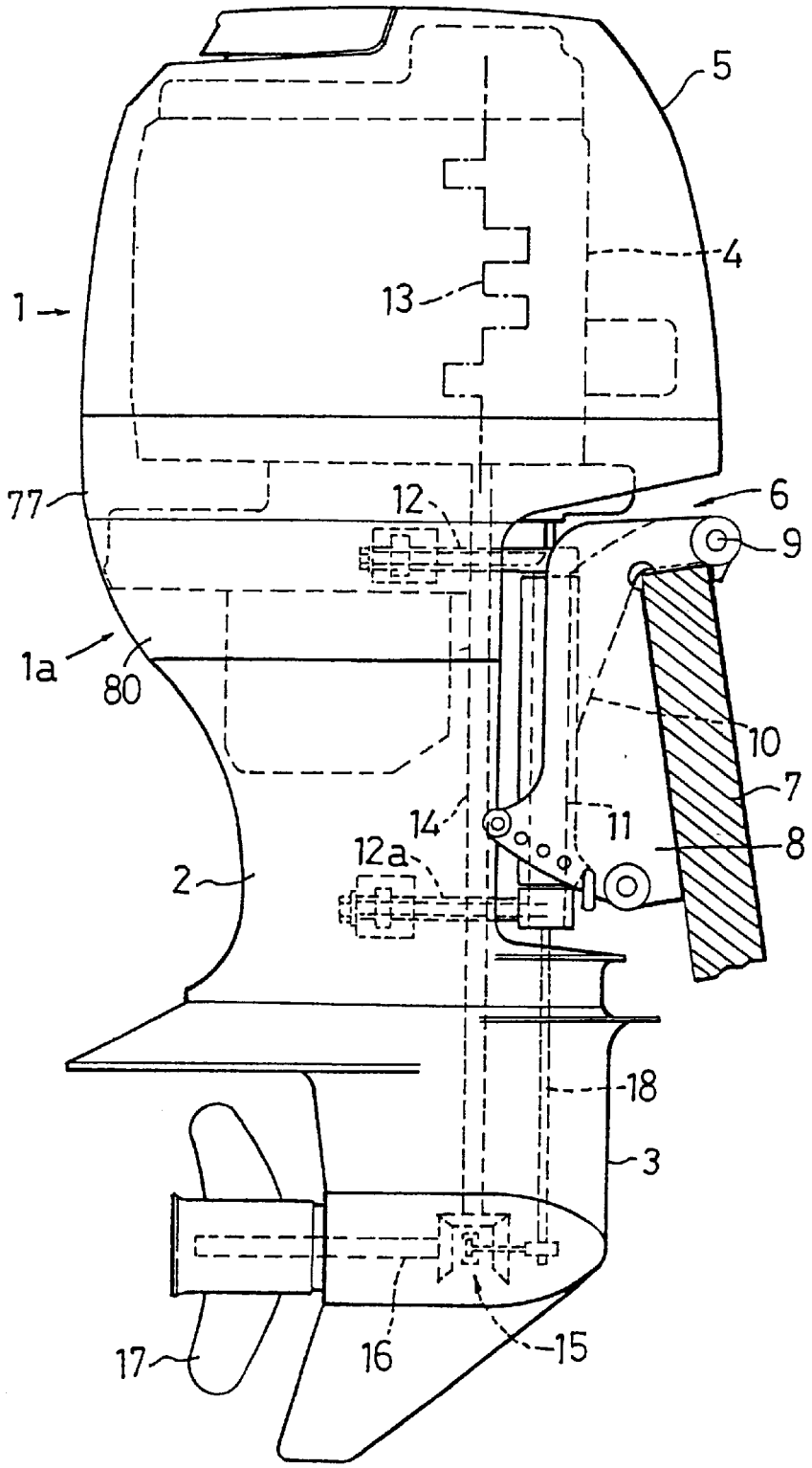

FIG. 13 is a side view of the entire outboard motor 1 to which the present invention is applied. Reference character 1*a* is an outboard motor body casing which includes an extension case 2, a gear case 3 and the like. An engine 4 is mounted at an upper portion of the outboard motor body casing la and has an upper portion covered with an engine cover 5.

The outboard motor 1 is mounted at a stern 7 through a mounting means 6. The mounting means 6 includes a bracket 8 fixed to the stern 7 through bolts, and a swivel case 10 pivotally mounted for vertically swinging movement to the bracket 8 through a tilting shaft 9 mounted to laterally extend over the entire length of the bracket 8. A swivel shaft 11 is rotatably carried in the swivel case 10 in a vertically directed manner. The outboard motor 1 is connected to the swivel shaft 11 through upper and lower connecting members 12 and 12*a*. Thus, the outboard motor 1 is swingable vertically about the tilting shaft 9 and turnable laterally about an axis of the swivel shaft 11.

The engine 4 has a crankshaft 13 vertically directed, and a driving shaft 14 is connected to the crankshaft 13 and extends downwardly within the extension case 2 to reach the inside of the gear case 3. The driving shaft 14 is connected at its lower end to a propeller shaft 16 through a forward and backward movement changing device 15 within the gear case 3. A propeller 17 is rotatively driven by an engine power transmitted via the crankshaft 13, the driving shaft 14, the forward and backward movement changing device 15 and the propeller shaft 16. Reference character 18 is an operating shaft for changing the forward and backward movements, which is rotatably provided to extend upwardly through the swivel shaft 11.

Figure 14:
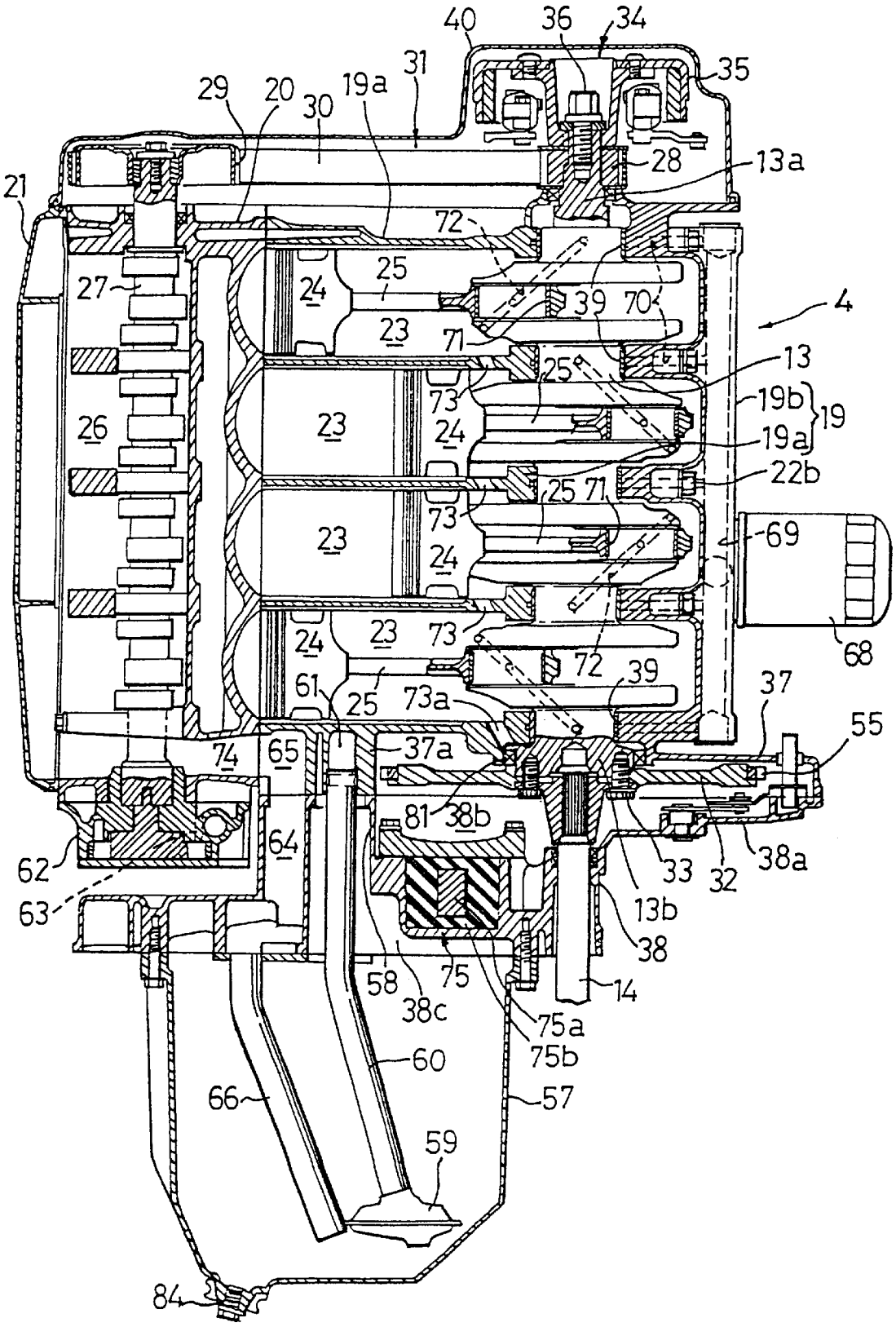

FIG. 14 is a vertical sectional view of the engine 4. The crankshaft 13 is directed vertically, as described above. As can be seen from FIG. 13, the engine 4 is mounted with the crankshaft 13 located toward a front portion of the outboard motor 1 (toward a boat). In FIG. 14, the right side corresponds to the front side of the outboard motor 1.

Figure 16:
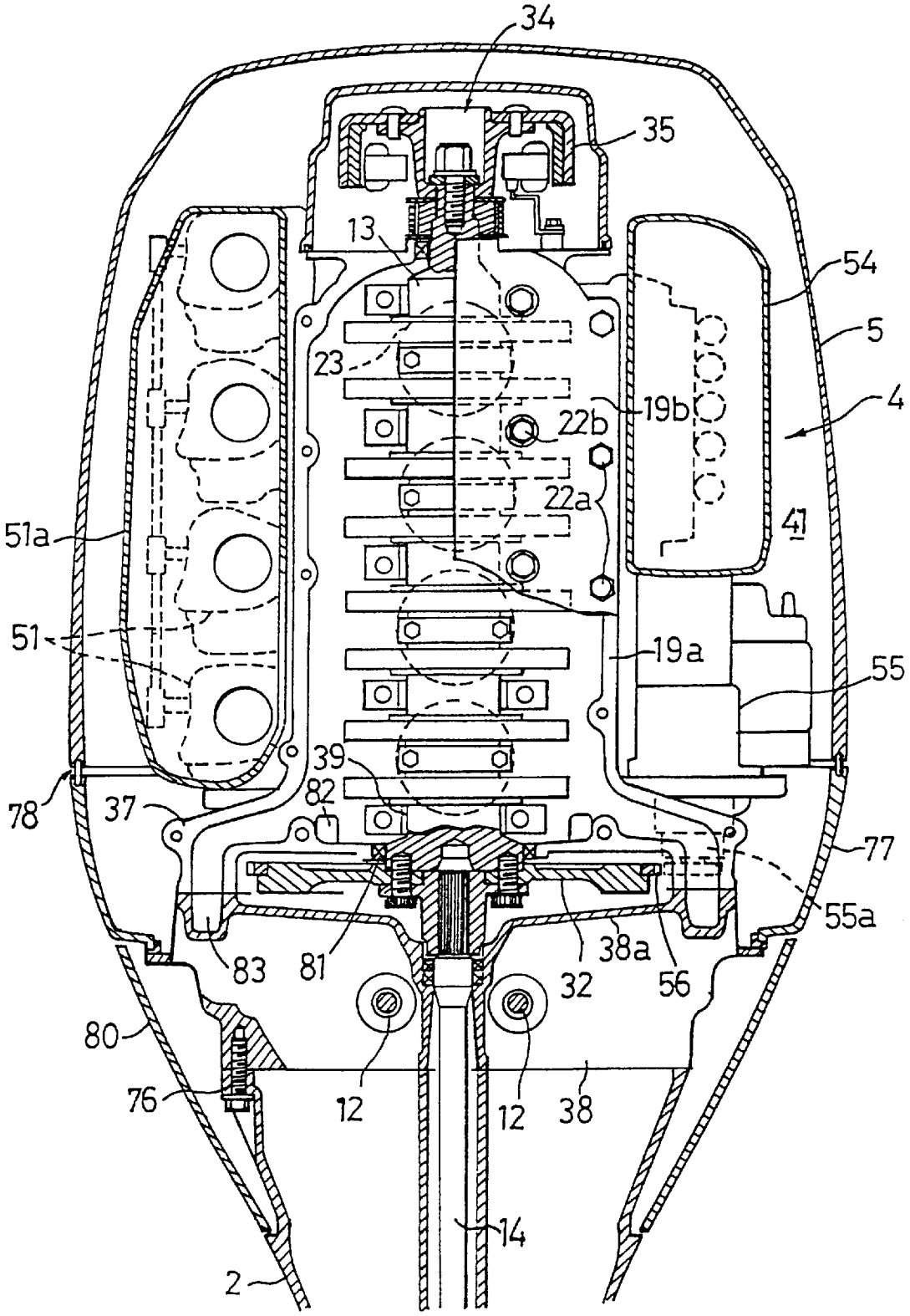
Figure 17:
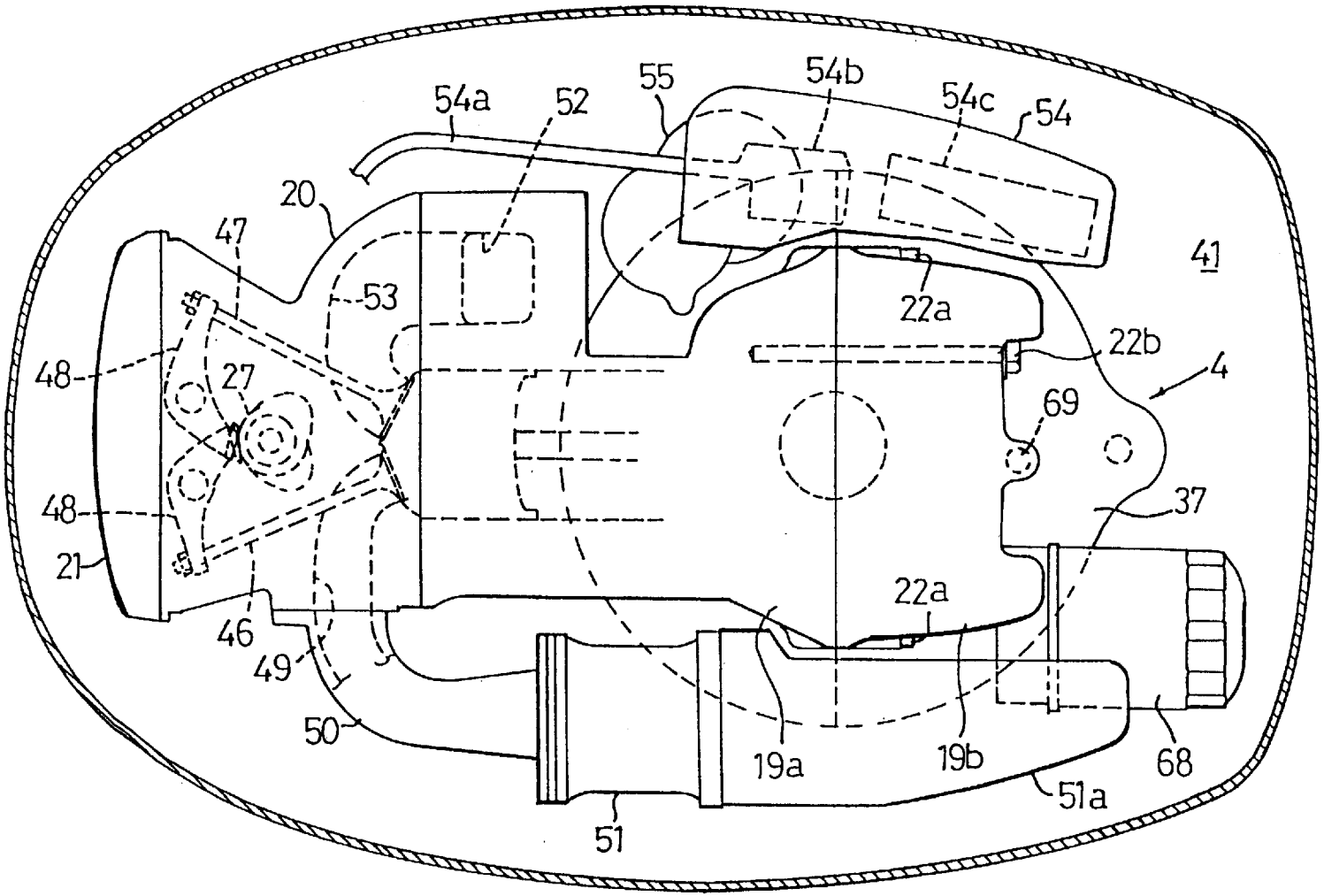

An engine body of the engine 4 includes a main block 19, a cylinder head 20 and a cylinder head cover 21. The main block 19 is constructed by integrally connecting a cylinder block 19*a* integrally provided with a skirt forming a half of a crankcase with a remaining crankcase portion 19*b* by bolts 22*a* (FIGS. 16 and 17). Four cylinders 23 are arranged in a row within the main block 19. Thus, the engine 4 is an inline 4-cylinder, 4-cycle engine, in which pistons 24 are connected to the vertically directed single crankshaft 13 through connecting rods 25. The crankshaft 13 in rotatably carried in the main block 19 in a manner that it is fastened by bolts 22*b* mounted in the cylinder block 19*a* and crankcase portion 19*b* and is sandwiched between opposed bearings.

A camshaft 27 is vertically disposed within a valve operating chamber 26 defined in the cylinder head 20. The cam shaft 27 is driven by the crankshaft 13 through a belt-drive transmission 31 which includes a driving pulley 28 mounted at an upper end of the crankshaft 13 protruding from the main block 19, a driven pulley 29 mounted at an upper end of the cam shaft 28 protruding from the cylinder head 20, and a belt 30 wound around the pulleys 28 and 29. The cam shaft 27 is in engagement with intake and exhaust valves for each cylinders 23 through rocker arms to control the motions of these intake and exhaust valves. That is, the belt drive transmission 31 forms a portion of a valve operating device for the engine 4.

The driving shaft 14 is connected to a lower end 13*b* of the crankshaft 13 protruding from the main block 19 and extends downwardly within the extension case 2, as described above. A disk-like flywheel 32 is further fastened to the lower end 13*b* by screws 33 to extend parallel to a lower surface of the main block 19. A dynamo 34 is mounted at the upper end 13*a* of the crankshaft 13 above the valve-operating driving pulley 28, with its rotor 35 fastened to the upper end 13*a* by a screw 36, so that it is rotated in unison with the crankshaft 13.

In this embodiment, the flywheel 32 is formed into a relatively thin disk-shape, and a low-level skirt portion (an upper case portion) 37 is integrally formed at a lower portion of the main block 19 and opens downwardly. The flywheel 32 is accommodated within the skirt 37. A mount case (lower case portion) 38 is mounted to a flat lower surface of the skirt portion 37 by bolts. The engine 4 is mounted in the extension case 2 through the mount case 38. The skirt portion 37 is provided with an enclosure wall 37*a* which surrounds an outer periphery of the flywheel 32.

The flywheel 32 basically has a required inertial mass only by itself, but is capable of distributing the inertial mass, inclusive of the rotor 35.

The rotor 35 is vertically high in level, as compared with the flywheel 32, but has a smaller diameter and has an inertial mass far less than that of the flywheel 32. Therefore, the diameter of the crankshaft end 13*a* adjacent the rotor 35 can be reduced and as a result, the diameter of the driving pulley can be reduced. If the diameter of the driving pulley is reduced, the diameter of the driven pulley 29 requiring a diameter twice the diameter of the driving pulley can be correspondingly reduced, which is convenient for reducing the overall size of the engine.

The belt-drive transmission 31 and the dynamo 34 are covered from above with a cover member 40. The cover member 40 is formed such that a portion corresponding to the dynamo 34, i.e., a portion near the front portion of the engine 4 is raised, and a rear portion is lowered to extend along the belt-drive transmission 31. The entire cover member 40 shown is integrally formed. The cover member 40 however may be vertically divided into a portion which covers the wrapping type transmission 31, and a portion which covers the dynamo 34, or longitudinally divided into a portion which covers a rear portion of the belt-drive transmission 31, and a portion which covers a front portion of the belt-drive transmission 31 and the dynamo 34.

Below the main black 19, a portion of the skirt 37 enclosing the outer periphery of the flywheel 32 by the enclosure wall 37*a* protrudes in a circular shape on opposite sides and forwardly (FIGS. 16 and 17). A similar protruding portion 38*a* is also provided on an upper and front portion of the mount case 38 in a face-to-face relation to this protruding portion of the skirt 37 (FIGS. 14 and 16). An-opening in the protruding portion of the skirt 37 is closed from below by the protruding portion of the mount case 38. This protruding configuration results in an enhanced rigidity of a surrounding portion.

An oil pan 57 is mounted in a depending or hanging-down manner on a flat lower surface of the mount case 38 formed below the protruding portion and near a rear portion, and is accommodated in the extension case 2. The inside of the mount case 38 is divided into a portion 38*b* defining an accommodating chamber for the flywheel 32 and a portion 38*c* communicating with the oil pan 57 by a partition wall 58 abutting against an end face of the enclosure wall 37*a*.

Figure 15:
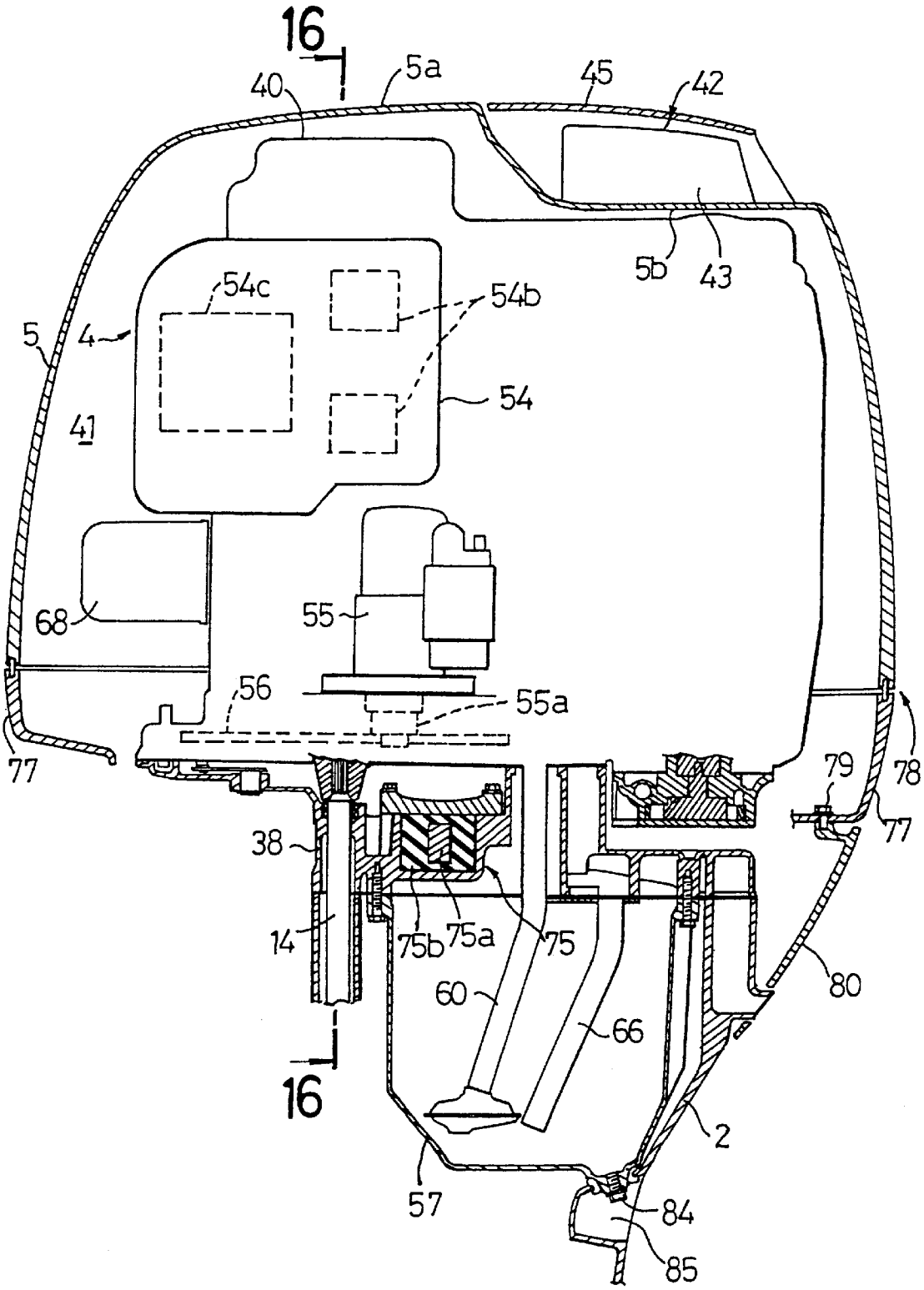

As shown in FIG. 16, the mount case 38 is fastened on its lower surface to an upper end of the extension case 2 by bolts 76. More specifically, the engine 4 is mounted in the extension case 2 through the mount case 38 and accommodated in an engine room 41 having its upper portion defined by the engine cover 5, but a lower portion of the engine room 41 is defined-by an undercase 77 (FIGS. 13, 15 and 16) which is supported at a peripheral edge of its lower end on the mount case 38 to cover the lower portion of the engine and which opens upwardly. FIG. 15 is a view of the inside of the engine room 41 as viewed from the opposite side from FIGS. 13 and 14 in vertical section of the cover member covering the engine 4, wherein the lower portion of the engine 4 is shown in a sectional view similar to that of FIG. 14.

The engine cover 5 is detachably mounted to the undercase 77 through a mating face 78 to cover an opening provided in an upper portion of the undercase 77. The outer periphery of a mount case 38 and the extension case 2 in the vicinity of a connection is covered by an undercover 80 which is fastened to the undercase 77 by a screw 79 (FIG. 15), and the outboard motor body 1*a* has a gentle profile provided by the undercase 77, the undercover 80 and the extension case 2.

Figure 18:
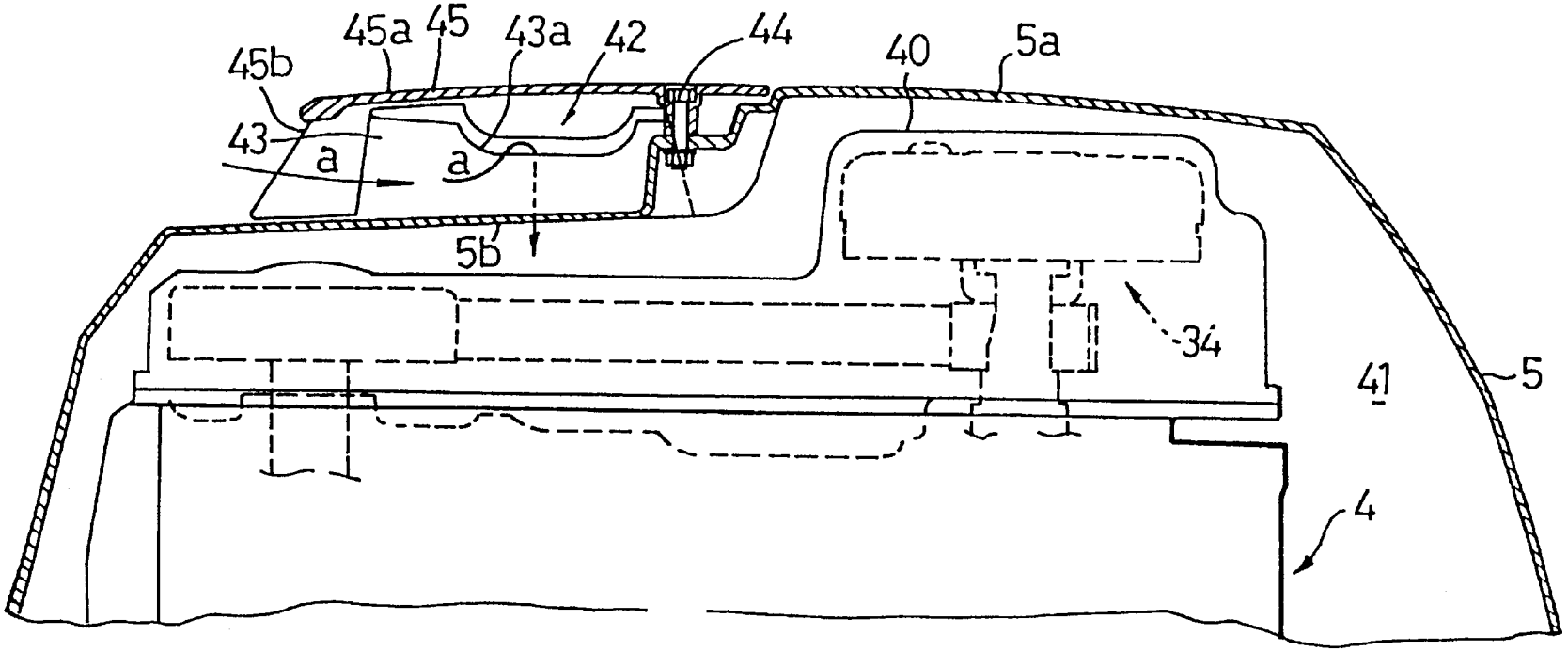
Figure 19:
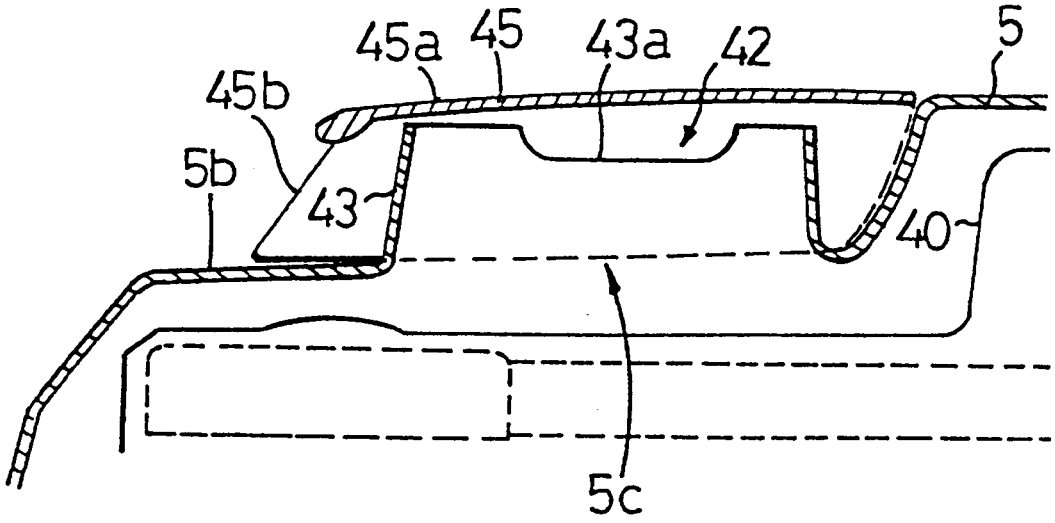

The upper surface of the engine cover 5 is formed into a shape corresponding to the cover member 40 (FIGS. 15, 18 and 19). More specifically, the engine cover 5 is formed in such a manner that a front portion 5*a* thereof corresponding to the dynamo 34 is higher in level, and a rear portion 5*b* of the cover 5 is lower in level. An air intake device 42 having a pair of left and right passage members 43 is disposed on this rear portion 5*b* formed at the lower level. As shown in FIG. 19, each of the passage members 43 is connected to a peripheral edge of an opening 5*c* provided in the engine cover portion 5*b* and extends upwardly, and further has a notched air introducing portion 43*a* provided at an upper opening edge.

The passage members 43 are covered at their upper portions with a cover member 45. The cover member 45 is fixed to the engine cover 5 by a bolt 44 at an intermediate forward position between the left and right passage member 43. The cover members 45 includes an upper plate portion 45*a* which covers the upper portion of the passage member 43, and a side plate portion 45*b* pendent along laterally opposite edges of the upper plate portion 45*a*. The passage member 43 raised on the lower engine cover portion 5*b* extends behind the dynamo 34 up to substantially the same level as the dynamo 34, so that it is superposed with the dynamo 34 laterally. An upper surface of the cover member 45 rearwardly extends flush with the upper surface of the front engine cover 5*a* without protrusion from the upper surface of the front engine cover 5*a*.

The open air is permitted to freely flow through a rear opening into a space defined above the engine cover portion 5*b* covered at its upper portion and opposite sides by the cover member 45, and is guided via the passage members 43 into the engine room 41 as shown by an arrow a in FIG. 18. Such air is used as an intake gas for the engine 4 to cool the periphery of the engine.

FIG. 17 is a schematic plan view illustrating the arrangement of the engine 4 and auxiliaries within the engine room 41. Reference character 46 is an intake valve; 47 is an exhaust valve; and 48 is a rocker arm. A valve mechanism comprising these members is provided for every cylinder 2 and controlled in opening and closing by the cam shaft 27. Reference character 49 is an intake port provided in the cylinder head 20. An intake pipe 50 is connected to the intake port 49 and extends forwardly along the side of the engine 4. A portion of air introduced via the passage members 43 into the engine room 41 is drawn into the Intake pipe 50 at a front end thereof and then via the intake port 49 into the cylinder 23. Reference character 51 is a carburetor, and 51*a* is an intake silencer. Such intake pipes 50 are provided for each cylinder 23 and vertically juxtaposed along the side of the engine 4.

At the other side of the engine 4, an exhaust passage 52 extends vertically, and an exhaust port 53 corresponding to each of the cylinders 23 is in communication with the exhaust passage 52. The exhaust passage 52 is connected to an upper end of an exhaust pipe (not shown) extending vertically within the extension case 2, so that an exhaust gas is passed through the exhaust pipe and released at a lower end of the exhaust pipe into water.

On the same side of the engine as the exhaust passage 52, an electrical equipment box 54 in which electric equipments are accommodated forwardly, and a starter motor 55 is disposed below the box 54 (see FIGS. 15 and 16). Reference character 54*a* is a spark plug wire which is connected to a spark plug provided in the side of the cylinder head 20. An igniting coil 54*b*, a CDI unit 54*c* and the like are accommodated in the electrical equipment box 54, but since the engine in the present embodiment is the 4-cycle, 4-cylinder engine, ignition can be achieved with only two coils 54*b* in total, one for two cylinders. These coils are disposed reasonably in a space above the starter motor 55, and the CDI unit 54*c* is disposed in a location closer to the front, which would not interfere with the starter motor 55. An output shaft 55*a* of the starter motor 55 is gear-meshed with a ring gear 56 (FIGS. 14, 15 and 16) which is mounted around the outer periphery of the flywheel 32.

As shown in FIG. 14, an oil intake pipe 60 having a strainer 59 at a lower end thereof extends upwardly from a bottom of an oil pan 57 through an oil pan communication portion 38*c* of the mount case 38 and is connected to an oil intake passage 61 defined in a lower portion of the main block 19. The oil intake passage 61 is in communication with an intake port 63 in an oil pump 62 which is provided at the lower end of the camshaft 27 and driven by the cam shaft 27.

Oil pressurized by the oil pump 62 is fed to various bearing portions around the camshaft 27 and via an oil passage (not shown) provided through the cylinder head 20, the cylinder block 19*a* and the crankcase 19*b* to an oil filter 68 mounted to the front surface of the crankcase 19*b*. The oil leaving the oil filter 68 flows into an oil passage 69 (see FIG. 17) vertically located in a laterally central portion of the front surface of the crankcase 19*b* and is further passed through an oil passage 70 to reach main bearings 39 of the crankshaft 13 to lubricate these bearings.

Further, the oil flows through an oil passage 72 provided in the crankshaft 13 to reach a crank pin bearing 71 and the inside of the cylinder 23 to lubricate the crank Pin bearing 71 and the inner surface of the cylinder. The cylinders 23 vertically arranged in a row are in communication with one another at locations closer to the crank chamber through oil bores 73, so that the oil in each cylinder 23 flows down In sequence through these oil bores 73 and is discharged from the lowermost oil bore 73*a* to a portion in the vicinity of the lower end of the crank shaft 13. However, this oil cannot flow into a chamber accommodating the flywheel 32, and is permitted to flow through an oil passage 82 (FIG. 16) for returning of the oil between the main bearing 39 at the lower end and a crankshaft oil seal 81 and through a return oil passage 83 (FIG. 16) for returning of the oil around the outside of the flywheel accommodating chamber to the oil pan communication portion of the mount case 38 and then returned into the oil pan 57.

Oil which has lubricated the portion around the cam shaft 27 is passed through an oil passage 74 to an oil return bore 65 and returned via an oil return passage 64 and an oil return pipe 66 to the oil pan 57. The oil pan 57 extends from the mount case 38 into the extension case 2, thereby ensuring that the height of engine 4 mounted cannot be increased. A drain plug 84 is provided at a front end of the bottom of the oil pan 57 to face a recess 85 defined in the extension case 2 as shown in FIG. 15. Alternatively, a recess 85 may be provided in the side of the extension case 2 to face the drain plug 84.

The mount case 38 is connected to the pair of left and right connecting members 12 (FIG. 13) through a rubber mount 75 which extends laterally. The rubber mount 75 includes a core member 75*a* and a rubber 75*b* which surrounds the core member 75*a*, and the connecting member 12 is connected to the core member 75*a* by a bolt.

What is claimed is:

1. An outboard motor comprising:

a V-type engine; and an engine mount case for mounting said engine, the engine having a plurality of cylinders arranged in a V configuration and a crankshaft directed in a vertical direction, wherein a flywheel is provided at a lower end of said crankshaft, and wherein an oil communication passage is defined in said engine mount case at a location rearwardly of said flywheel, and an exhaust passage for passage of the exhaust from said engine is defined in said engine mount case at a location rearwardly of said oil communication passage.

* * * * *